US008291916B2

(12) United States Patent
Belcastro et al.

(10) Patent No.: US 8,291,916 B2
(45) Date of Patent: Oct. 23, 2012

(54) PARALLEL CIGARETTE FILTER COMBINING TECHNIQUES WITH PARTICLE FILLING OF CAVITIES

(75) Inventors: Marc D. Belcastro, Glen Allen, VA (US); Loren Duvekot, Goochland, VA (US)

(73) Assignee: Philip Morris USA Inc., Richmond, VA (US)

( * ) Notice: Subject to any disclaimer, the term of this patent is extended or adjusted under 35 U.S.C. 154(b) by 1233 days.

(21) Appl. No.: 11/315,520

(22) Filed: Dec. 22, 2005

(65) Prior Publication Data

US 2006/0157070 A1 Jul. 20, 2006

Related U.S. Application Data

(60) Provisional application No. 60/640,531, filed on Dec. 30, 2004.

(51) Int. Cl.
*A24C 5/52* (2006.01)
*A24D 3/06* (2006.01)

(52) U.S. Cl. ..... 131/94; 131/342

(58) Field of Classification Search ..... 131/94, 131/198, 342, 202–204
See application file for complete search history.

(56) References Cited

U.S. PATENT DOCUMENTS

| | | | | |
|---|---|---|---|---|
| 2,821,200 | A | 1/1958 | Korber | |
| 3,306,306 | A | 2/1967 | Rudszinat | |
| 3,308,832 | A * | 3/1967 | Stelzer et al. | 131/94 |
| 4,411,640 | A | 10/1983 | Hall | |
| 4,815,481 | A | 3/1989 | Hirose et al. | |
| 5,221,247 | A | 6/1993 | Budjinski, II et al. | |
| 5,875,824 | A | 3/1999 | Atwell et al. | |
| 6,805,174 | B2 * | 10/2004 | Smith et al. | 141/67 |
| 2003/0034085 | A1 * | 2/2003 | Spiers et al. | 141/125 |

FOREIGN PATENT DOCUMENTS

WO WO03/016137 * 2/2003

* cited by examiner

*Primary Examiner* — Matthew Daniels
*Assistant Examiner* — Jodi C Franklin
(74) *Attorney, Agent, or Firm* — Connolly Bove Lodge & Hutz LLP

(57) ABSTRACT

Apparatus and method for forming cigarette filters comprise a single or multiple hopper system for forming filter components of single or multiple sizes. The filter components with spaces therebetween are partially wrapped and then conveyed to at least one media applying wheel where media is deposited into the spaces between the filter components. A cover cap is formed and placed over the partially wrapped filter components downstream of the media wheel to thereby completely wrap the filter components. Subsequently, the completely wrapped filter components are joined to tobacco rods with tipping paper.

4 Claims, 3 Drawing Sheets

10
12
14
16
18
20
22
24
26
28
30
32
34
36
38
40
42
44
46
48
50

PARALLEL CIGARETTE FILTER COMBINING TECHNIQUES WITH PARTICLE FILLING OF CAVITIES

CROSS REFERENCE RELATED TO APPLICATION

The present application claims the benefit of provisional application Ser. No. 60/640,531, filed Dec. 30, 2004, for all useful purposes, and the specification and drawings thereof are included herein by reference.

BACKGROUND OF THE INVENTION

Production lines for tobacco products often involve processing long rod shaped articles in a series fashion either continuously or through a series of drums to obtain a desired final result. Such a production line can comprise a plain cigarette processing apparatus (a cigarette rod maker or "maker"), such as by way of example a machine that is available from Hauni Machinenbau AG of Hamburg, Germany under the trade name PROTOS, a filter rod apparatus ("tipping machine"), such as by way of example a machine that is available from Hauni Machinenbau AG of Hamburg, Germany under the trade name MAX, and a packing machine.

There are a number of patents related to the delivery of particles to filter assemblies that are manufactured in a serial stream. For example, U.S. Pat. No. 4,411,640 to Hall discloses an apparatus for forming filter mouthpieces wherein plugs are fed in a serial manner. Gaps are formed using a separating means and these gaps are filled with material by a media wheel. U.S. Pat. No. 5,221,247 to Budjinski, II et al. teaches a similar device and method.

There are also patents related to the assembly techniques of filter combining. For instance, U.S. Pat. No. 3,306,306 to Rudszinat teaches a well known two hopper design for the production of filter components. Standard sized filter rods are fed from two hoppers to a series of cutting, staggering, spreading and alignment drums. Depending on which hopper and corresponding drums the filter passes though, filters of a first or second size will be produced. U.S. Pat. No. 4,815,481 to Hirose et al. also teaches two hopper design for feeding filter tips and tip halves through machinery to join these two components together with cigarettes.

U.S. Pat. No. 3,308,832 to Stelzer et al. discloses a method of production for forming filter mouthpieces of ultimate or unit length comprising two rod shaped outer filters of identical material and intermediate or inner filters of granular material. Also disclosed is a method and apparatus for forming multiple intermediate filters of a unit size to form a more complex filter.

U.S. Patent Application Publication 2003/0034085 teaches an apparatus and method for filling cavities with metered amounts of granulated particles.

In contrast, the present invention provides parallel combining of filter components, the filling of cavities in a parallel method, and the addition of a paper cap.

One of the limitations of the prior technologies used to combine filter components is the registration (positions) of the components to each other as well as to the final cut of the filter assembly. The process of transferring multiple components into the serial stream often results in unintentional gaps, components having the wrong lengths, or the total lack of a component being present. In addition to these issues, once the serial filter assembly is wrapped and sealed in a paper, the continuous serial filter assembly is then cut into lengths. This cutting process creates two additional areas where non-conforming products are produced: Cut registration and overall filter length. In contrast, the present invention provides techniques which eliminate most if not all of these issues. While the issue of unintentional gaps between components is not completely eliminated in these techniques, the impact on the finished product will be minimized. In prior processes, unintentional gaps between filter components cause the entire serial stream to change position and could affect the final cut registration. In contrast, the process provided by the present invention ensures that the inconsistent assembly of components will only affect the one filter assembly. Inspection techniques will allow the non-conforming assemblies to be identified and removed.

Furthermore, according to prior techniques for the filling of cavities, the possibility of these particles ending up trapped outside the pocket region but under the filter wrap exceeds acceptable limits. These particles would be rendered visible to the consumer by, for instance, ending up in an area near the exposed end of the filter when it is combined with the cigarette and wrapped with tipping paper. The prior art used several different methods to eliminate this possibility. Techniques to inspect filters for this scatter or combining the filter assembly with an additional solid acetate filter component to cap the end of the product, are examples of two methods used in the prior art. Both of these methods are expensive, increase production waste, and complicate the entire manufacturing process.

The techniques provided by the present invention achieve almost complete elimination of particle scatter. Because the first paper wrap is attached to the filter component assembly prior to the cavity filling process, the possibility for the particles to be trapped between the paper and the filter components is minimized. While it is not guaranteed that all of the particles transferred from the drum end up in the cavity, there is no area where the particle can come to rest on the surface of the filter assembly. Once the paper cap is applied, the particles are retained in the cavities.

Prior methods for the assembly of combined filters are also limited by several factors relating to productivity. In the process of combining two different components to make a plug filter assembly, the techniques used to transfer the assembly into a serial stream so paper can be applied and the filter assembly cut is normally limited to less than 400 meters per minute. As the make up of the components increase in complexity or the addition of cavities filled with particles are introduced, this maximum speed drops to less than 250 meters per minute. Using a typical 108 millimeter filter as an example, these prior processes can produce 1,900 to 3,800 filter assemblies per minute, the limiting factor being the ability to deliver particles from the delivery drum to the cavities. Past experience indicates that these prior processes can operate effectively and efficiently up to linear speeds of 300 meters per minute. In contrast, the present invention provides a parallel method that can produce up to 8,000 filters per minute.

Finally, the present invention provides a process which significantly reduces material waste, particularly at machine startup and machine stoppage. Waste reductions from minimizing non-conforming filters should also be realized.

SUMMARY OF THE INVENTION

The present invention provides a new equipment group that will produce a combined cigarette filter with cavities that are filled with particles, wherein the filter components will be assembled, wrapped with paper, and the cavities filled in a parallel method. This invention provides a method to assemble the filter components, add the paper wrap, and fill one or multiple pockets with particles, all in a parallel format. The result is an apparatus and method with higher quality, higher processing speed, reduced demands on manpower, and reduced material waste.

In addition to this first embodiment where the equipment group would produce a cavity filled combined filter, a second embodiment merges this combining technology into the cigarette assembly process to combine filters, fill the cavities with particles, and then merge the filter assembly with the tobacco rod component to complete the cigarette construction, all in one equipment grouping or module.

BRIEF DESCRIPTION OF THE DRAWINGS

Novel features and advantages of the present invention in addition to those mentioned above will be readily apparent to persons of ordinary skill in the art from a reading of the following detailed description of the preferred embodiments in conjunction with the accompanying drawings wherein similar reference characters refer to similar parts and in which.

DETAILED DESCRIPTION OF THE INVENTION

Figures 1, 1A:
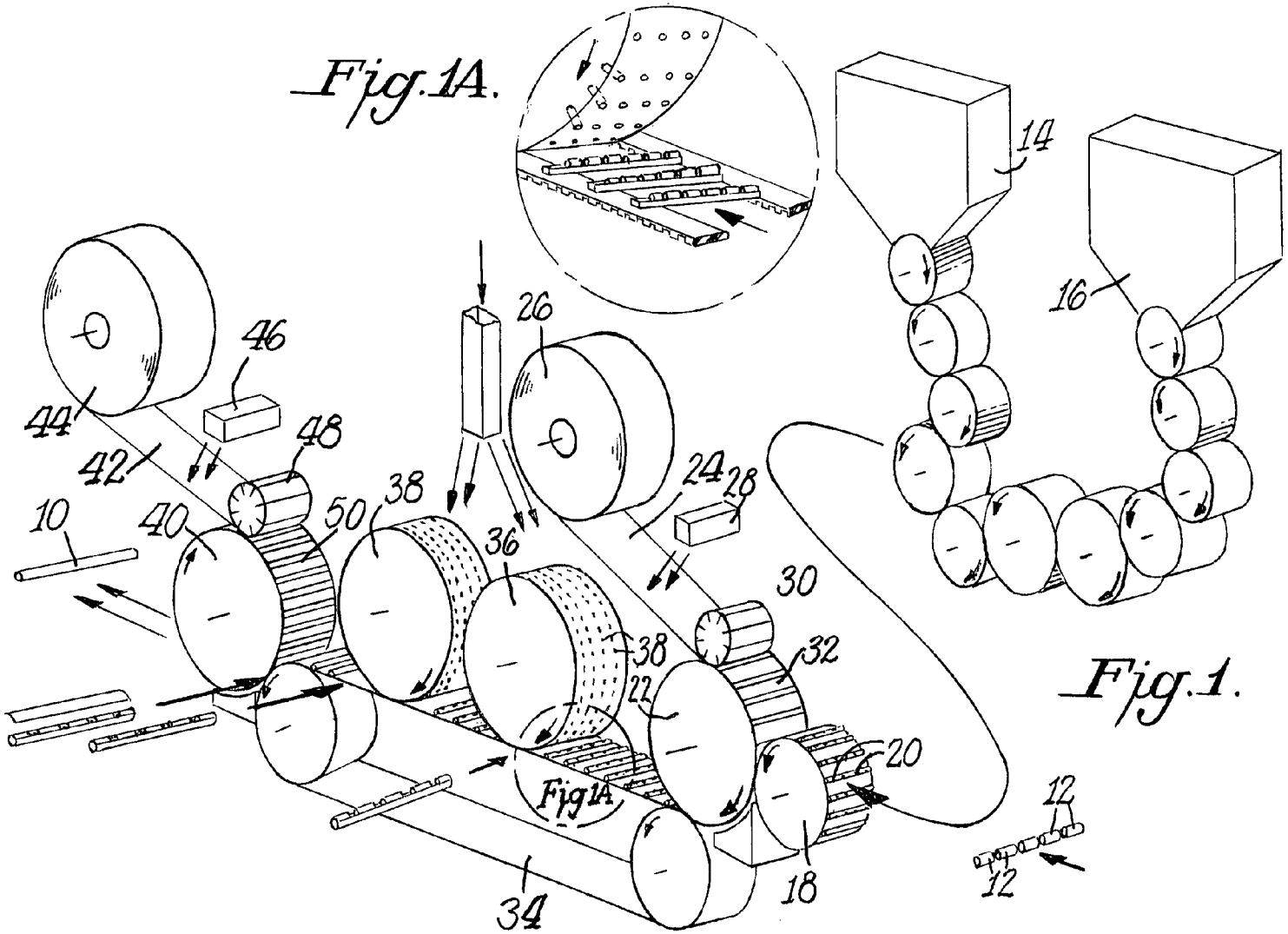
FIG. 1 shows schematically a multi component cigarette filter manufacturing process and apparatus, according to a first embodiment of the present invention.
FIG. 1A is an enlarged portion of FIG. 1 illustrating details at a particular location of the apparatus.

The filter component assembly of FIG. 1 shows one embodiment of the invention where filter components are processed to form finished combined filters. The method and apparatus of FIG. 1 will now be discussed in greater detail.

The filter assembly 10 is a combination of multiple segments 12 combined from base components that would enter the machine through the component hoppers 14, 16. The finished filter assembly could be a combination of only one or multiple unique base filter components 12. An example of this type of combining technology is the Hauni Mulfi -GC or a Dual Hopper Max such as described in commonly assigned U.S. Pat. No. 5,533,610, incorporated herein by reference.

Combining technology permits first filter rods to be prepared for the formation of combined filters. The filter rods are fed through a hopper system where they are cut, staggered, aligned, separated and otherwise processed to obtain components with predetermined characteristics including length. The filter components are then placed on a first drum 18 where they are arranged in any predetermined configuration. The components are held in place in flutes 20 in the first drum using a vacuum or other securing means and carried to a second drum 22.

Following the assembly and aligning of the multiple filter components that make up the filter assembly, a paper wrap 24 can be applied to the assembly using existing technologies that are typical on any cigarette tipping assembly machine. For example, the components may be transferred to the second drum where the components are partially wrapped. Partial wraps are formed by feeding plug wrap 24 from a first plug wrap supply 26 to the second drum. The plug wrap may undergo an adhesive application 28, such as adding patterned glue, to assist with the placement of filter components relative to the partial wrap. As the paper meets drum flutes in the second drum, a wheel with discreet knives 30 contacts the paper, cutting the paper into partial wrap patches 32. This process only partially wraps the paper around the circumference of the filter assembly. The amount of wrap may be dependent on the amount of particle loading the product would require. The partial wrap may cover between 250 and 300 degrees of arc about the filter assembly's circumference.

The partially wrapped components then travel to a conveying device 34. The conveying device shown in FIG. 1 comprises a belt with fluted pockets, but could include any means for moving the partially wrapped rods through the subsequent steps of the process. The filter assembly that was traveling on the surface of the rotating drum maintains the same relative speed as it is transferred from the drum to the belt, which is traveling in a linear fashion. When the filter assembly transfers to the belt arrangement, the partially wrapped filter assembly is positioned so that the unwrapped portion of the assembly is facing up (i.e. the unwrapped area is diametrically opposing the bottom of the fluted pocket).

At this point in the process open space remains between the partially wrapped filter components 12. The partial wraps are carried along the conveying means in a parallel, but linear, direction, so that particles can be delivered to the pockets between the filter components. Particle delivery could be done in a number of methods such as free fall dumping, pocketed chain, or pocketed filling drums. According to one example, a vacuum assisted metering drum (or "media wheel") 36 may be used. Drum 36 may have cavities and flutes aligned generally with the filter and more particularly with the pockets between filter components. The vacuum assisted metering wheel includes one or more rows of pockets along its periphery which come into communication with a vacuum plenum to draw particles into the pockets as the wheel rotates through a hopper. Upon further rotation the vacuum is interrupted and the particles are released. The drum filling technology can be modified in any of a number of ways including increasing the number of pockets 38 across the width of the drum. FIG. 1 depicts four pockets that deliver the particles to the filter assembly because the assembly has four cavities, though other configurations are conceived. The first pocketed filling drum 36 can be designed to accept one or more additives such as charcoal and/or flavors to fill one or more pockets per filter. Granular media is then transferred into the pockets left in the partial wrap.

The partially wrapped assemblies can then be transported to a second pocketed filling drum 38. Such a drum could be used to ensure that the cavities are completely filled, or to deliver a different particle to a different pocket. In the latter case, the finished filter segment, the part that is attached to the cigarette rod, would be comprised of multiple filter components and two cavities where particles are deposited.

Once the desired types and amounts of granules are transferred into the pockets the filter assembly continues in a parallel direction to a drum 40 where paper wrap 42 is applied to the filter assembly. In a manner similar to the first plug wrapping operation, second plug wrap is formed by feeding plug wrap 42 from a second plug wrap supply 44 to the third drum 40. The plug wrap can include an applied adhesive 46 to assist with the placement of filter components relative to the partial wrap. As the plug wrap meets the third drum, a knife wheel 48 contacts the paper cutting the paper into capping paper patches 50. The width of this paper cap may be dependent on the amount of unwrapped circumference of the filter assembly. The paper cap would normally over wrap the original wrap by 10° on each side. Thus, the partial wraps contact the paper caps 50 to form a capped plug wrap.

Following the application of the paper cap, the assembly would be transferred from the linear traveling belt back to a rotating drum with pockets. The assembly may then pass through a normal rolling process to ensure the proper attachment of the paper cap. The complete filter assembly could then further pass through well known inspection devices to verify the presence or absence of each of the filter components before being transferred into a conveyor that removes the combined filters from the machine.

Figure 2:
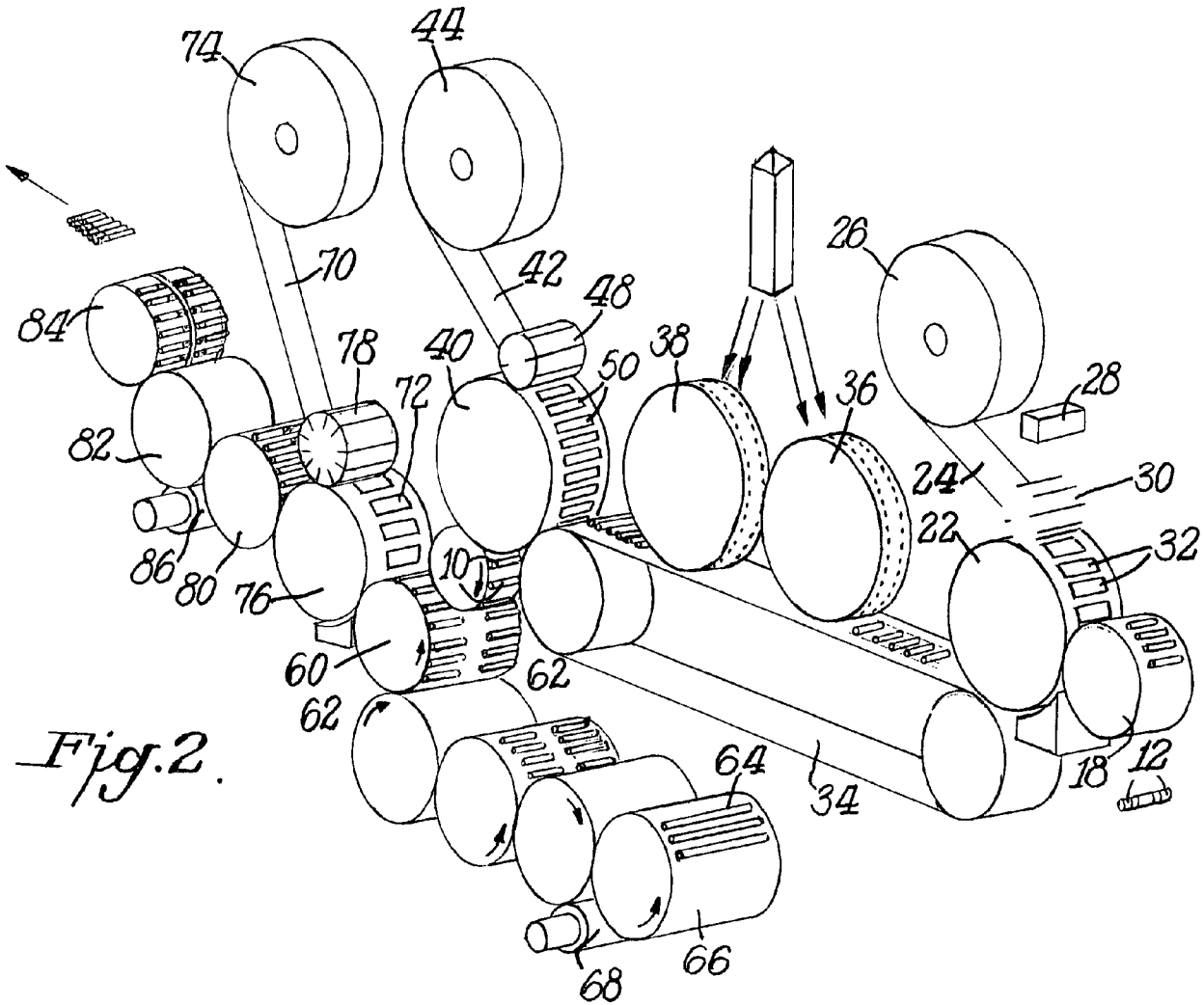
FIG. 2 shows a schematic of a second embodiment of the present invention wherein a double filter combination is processed to produce a finished cigarette.

In an alternate embodiment depicted in FIG. 2, the same technology is used to construct the filter assembly, partially wrap the filter assembly, fill the cavities, apply the paper cap, and inspect the finished product. However, the filter assembly shown in FIG. 2 comprises the necessary components to be attached to a pair of tobacco rods.

Following the inspection of filter assemblies similar to those described to FIG. 1, the double wide filter assembly 10 can then be transferred to converging drum 60 where the filters can be converged with tobacco rods 62.

The converging drum accepts single separated tobacco rods 62. The rods are formed by feeding first double tobacco rods 64 to a first tobacco processing drum 66. The double rods are cut at 68 and then separated, as shown in FIG. 2, to align them for the converging operation performed at the converging wheel 60.

The filter assembly is fed into the gap between a double cigarette pair that was cut and separated. From this point, typical cigarette filter assembly technologies are used to push the double cigarette assembly together and apply tipping paper 70. For example, tipping patches 72 can be formed by feeding tipping paper from a tipping paper supply 74 to the tipping patch drum 76. As the tipping paper meets the drum, a wheel with discreet knives 78 contacts the paper, cutting the paper into tipping paper patches 72. Finished filters 10 and tobacco rods 62 are contacted with the tipping paper 70 and folded circumferentially to form tipped double cigarettes. The tipped double cigarette can then be carried along additional drums 80, 82, 84 where the double cigarette is cut in half at 86 to form two singular cigarettes with the filter ends facing each other. The cigarettes can then be fed through a device to face them in the same direction so that the cigarettes can be packaged in any predetermined manner.

Typical inspection technologies can be used on the finished product and any non-conforming product may be removed from the product stream. The filter assembly that was inspected prior to being combined with the cigarette rod can also be removed from the production stream at the end of the process, if it was determined that the filter assembly did not conform to specifications.

Figure 3:
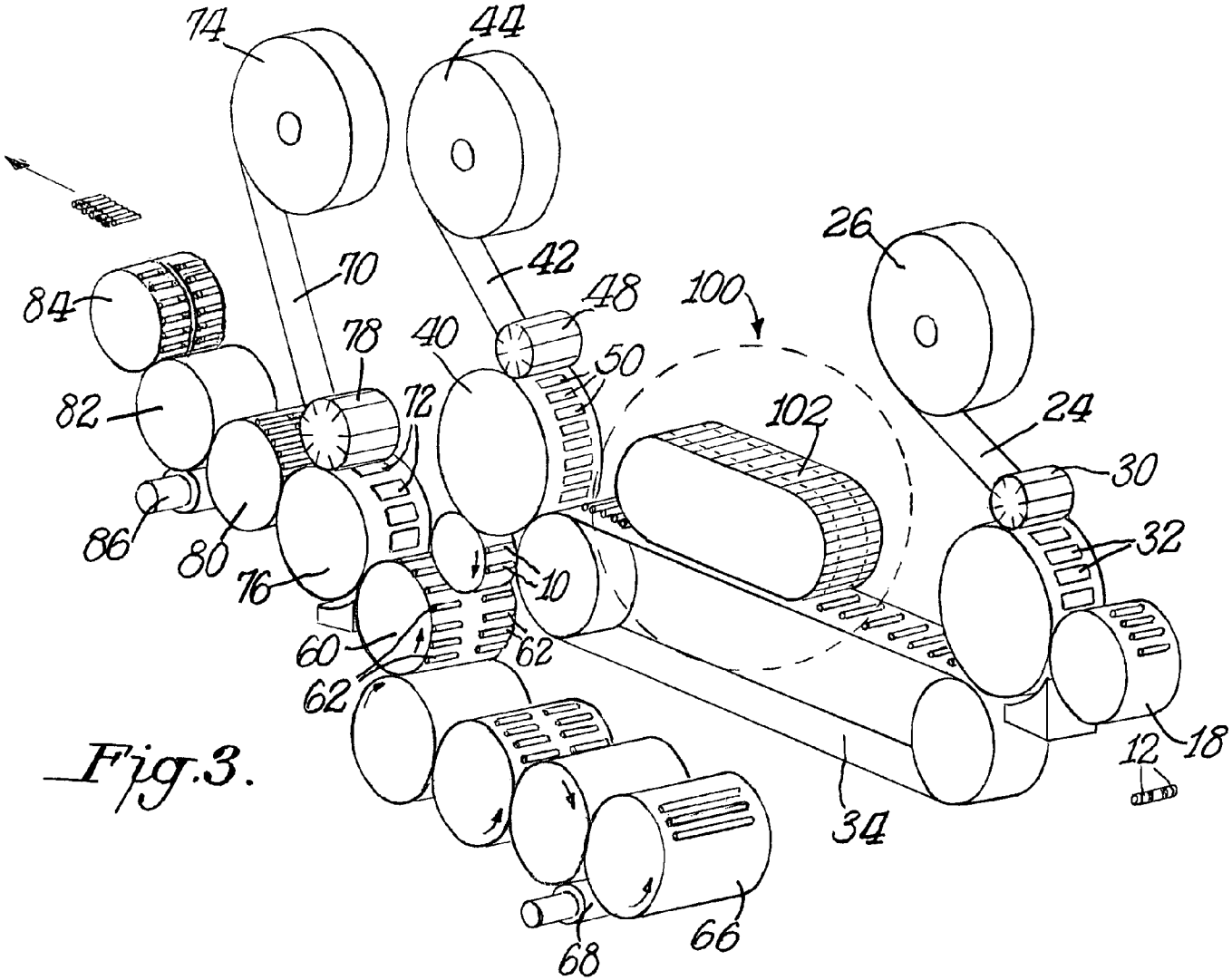
FIG. 3 shows a schematic of a third embodiment of the present invention wherein the cavity filling device is a particle filling chain or belt with pockets.

FIG. 3 shows an alternative embodiment 100 for cavity filling using a filling chain or belt 102 for particle delivery. Otherwise this embodiment is the same as shown in FIG. 1, and similar reference characters have been used to identify similar parts. This embodiment could be used in conjunction with the methods and apparatuses disclosed above, particularly with respect to FIGS. 1 and 2.

Although the method and apparatus have been described in detail by way disclosed embodiments, this disclosure is not meant to limit the invention and one could adjust or alter aspects of the disclosed detailed embodiment without diverging from the invention. For instance, other filter component sizes and layouts could be conceived without changing the benefits conferred by the present invention.

What is claimed:

1. An apparatus for forming cigarette filters comprising:

a single or multiple hopper system for forming sets of filter components;

partial wrapping means for delivering a partial wrap and for partially wrapping the sets of filter components with the partial wrap with spaces between the filter components;

conveying means for transporting the sets of partially wrapped filter components in a downstream direction including a liner path of travel with the partially wrapped filter components spaced apart and parallel to one another on the linear path of travel;

at least one media wheel for simultaneously dispensing media into the spaces between each partially wrapped set of filter components, the sets arranged parallel to one another on the linear path of travel of the conveying means with the simultaneous dispensing at the nip of the media wheel and linear path of travel of the conveyor means; and complete wrapping means for supplying a separate cover cap and placing the separate cover cap on the partially wrapped filter components downstream of the media wheel to thereby completely wrap the filter components and media therebetween.

2. An apparatus as in claim 1 including two media wheels both above the linear path of travel of the conveyor means, one downstream of the other for dispensing media into the spaces between the filter components.

3. An apparatus as in claim 1 including cigarette rod supply means for delivering and aligning cigarette rods with the completely wrapped filter components, and means joining the completely wrapped filter components and tobacco rods together with tipping paper and with a tobacco rod at each end of the completely wrapped filter components.

4. An apparatus as in claim 1 wherein the conveying means includes a horizontal belt arrangement for transporting partially wrapped parallel and spaced apart sets of filter components in a linear downstream direction with the unwrapped portions facing in an upward direction.

* * * * *